US005513757A

United States Patent [19]

Papetti

[11] Patent Number: 5,513,757

[45] Date of Patent: May 7, 1996

[54] CONTINUOUS CUT SLOTTED SCREEN BASKET

[75] Inventor: Richard R. Papetti, North Easton, Mass.

[73] Assignee: Sulzer Papertec Mansfield Inc., Mansfield, Mass.

[21] Appl. No.: 252,759

[22] Filed: Jun. 2, 1994

[51] Int. Cl.[6] ..... B07B 1/49

[52] U.S. Cl. ..... 209/406; 209/273; 209/411; 210/498

[58] Field of Search ..... 209/273, 305, 209/306, 391, 392, 395, 397, 406, 409, 411; 210/413, 497.01, 498

[56] References Cited

U.S. PATENT DOCUMENTS

| | | | |
|---|---|---|---|
| 3,631,981 | 1/1972 | Young | 209/399 |
| 3,716,144 | 2/1973 | Bartlow . | |
| 3,957,652 | 5/1976 | McGonigal . | |
| 4,313,992 | 2/1982 | Spiewok . | |
| 4,529,519 | 7/1985 | Holz | 209/393 X |
| 4,986,900 | 1/1991 | Mason | 209/273 X |
| 5,047,148 | 9/1991 | Arai | 210/498 |
| 5,059,324 | 10/1991 | Chen | 209/397 X |
| 5,064,537 | 11/1991 | Chupka et al. | 209/273 X |
| 5,094,360 | 3/1992 | Lange | 209/411 X |
| 5,128,028 | 7/1992 | Lamort | 209/397 |
| 5,200,072 | 4/1993 | Frejborg et al. | 210/232 |
| 5,234,550 | 8/1993 | Ekholm et al. | 210/498 X |
| 5,255,790 | 10/1993 | Einoder et al. | 210/498 X |

FOREIGN PATENT DOCUMENTS

| | | | |
|---|---|---|---|
| 207690 | 9/1986 | Japan | 209/273 |

*Primary Examiner*—Willaim E. Terrell
*Assistant Examiner*—Tuan Nguyen
*Attorney, Agent, or Firm*—Samuels, Gauthier & Stevens

[57] ABSTRACT

A continuous cut slotted screen basket for removing contaminants from papermaking stock is disclosed. The screen basket has a wall member with first and second sides. Blind parallel first slots are cut into and are spaced across the first side. The first slots are continuous and are separated from the second side by webs of reduced wall thickness. Mutually spaced reinforcing elements are secured to the first side. The reinforcing elements extend transversely across the first slots and are spaced from the webs of reduced wall thickness. Continuous second slots are cut through the webs. The second slots are parallel to and communicate with respective first slots.

6 Claims, 5 Drawing Sheets

CONTINUOUS CUT SLOTTED SCREEN BASKET

BACKGROUND THE INVENTION

1. Field of the Invention

This invention relates generally to filter elements, and is concerned in particular with an improvement in the design and manufacture of green baskets for use in removing contaminants from papermaking stock.

2. Description of the Prior Art

U.S. Pat. No. 3,631,981 (Young) discloses one known method of manufacturing screen baskets by first cutting mutually aligned and communicating screening and relief slots into opposite faces of a plate, after which the plate is rolled into a cylinder and reinforced by circular ribs or bands. The screening slots are continuous, but the relief slots are interrupted by lands and are thus discontinuous. A disadvantage of this arrangement is that the lands create blockages in the screening slots, thereby reducing filtering capacity while also providing sites at which solids can snag and begin to accumulate. These problems are exacerbated by the arcuate extensions at the ends of the lands which result from "plunge cutting" the relief slots with circular saw blades. The discontinuous relief slots aim weaken the screen basket structure by creating sites for fatigue failure due to higher stress concentrations at the slot ends.

Efforts have been made to remove the arcuate extensions at the ends of the lands by resorting to further manufacturing operations, but the additional expense of doing so impacts unfavorably on the overall cost of the resulting product. Moreover, the structural integrity of the screen basket can be compromised by these additional manufacturing operations, thus necessitating the incorporation of additional reinforcement.

Other cutting methods involving the use of laser beams, electron beams, water jets, etc. do not produce arcuate extensions at the ends of the lands. However, the lands are still required in order to maintain structural integrity during manufacturing. Thus, screening slot blockage remains a problem, even with slotted screen baskets produced by these other cutting methods.

As disclosed in the U.S. Pat. Nos. 3,716,144 (Bartlow) and 5,255,790 (Einoder et al), it is also known to fabricate screens from a plurality of wires secured by welding or brazing to transversely extending support elements. The wires are profiled and suitably spaced to define continuous screening slots communicating with continuous relief slots, the latter being traversed at spaced locations by the support elements. This arrangement has the advantage of providing screening slot continuity. However, this advantage is largely offset by the non-uniform slot widths which result from the difficulty of maintaining a constant precise spacing between the wires. This difficulty is compounded by the thermal distortions that almost invariably accompany welding or brazing operations.

SUMMARY OF THE INVENTION

An object of the present invention is to provide a new and improved slotted-type screen basket which avoids or at least significantly minimizes the disadvantages and drawbacks of the prior art.

A more specific object of the present invention is to provide a slotted-type screen basket with excellent structural integrity and with continuous screening slots of uniform width.

A related object of the present invention is to provide an improved and cost effective method of manufacturing slotted-type screen baskets.

These and other objects and advantages of the present invention are achieved by providing a flat plate having first and second sides. Blind first slots are cut into and spaced across the first side. The first slots are separated from the second side of the plate by webs of reduced plate thickness. Mutually spaced reinforcing elements are secured to the first side of the plate to form an integral assembly. The reinforcing elements extend transversely across the first slots at locations spaced from the connecting webs. Second slots are cut through the connecting webs to thereby coact with the first slots in providing fluid communication between the first and second sides of the plate. The entire assembly is then formed into a screen basket configuration which typically will comprise a cylinder or a portion of a cylinder.

In a preferred embodiment of the invention to be described hereinafter in greater detail, the first and second sides constitute accept and feed sides, and the first and second slots are respectively relief and feed slots.

Preferably, the feed side of the plate is additionally provided with contour slots which extend parallel to and are at least partially aligned with respective relief slots. The contour slots contribute to beneficial turbulence which enhances capacity and efficiency at the feed side while also reducing the thickness of the connecting webs, thereby facilitating the cutting of the screening slots.

The relief, contour and screening slots are all continuous and are preferably cut into flat plate stock which is then formed into a screen basket configuration. Alternatively, however, it is contemplated that the aforesaid slots may be cut into plate stock after it has been formed into its final shape.

BRIEF DESCRIPTION OF THE DRAWINGS

FIGS. 4A–8A are enlarged sectional views taken on lines 4A–8A respectively of FIGS. 4–8;

DESCRIPTION OF PREFERRED EMBODIMENTS

Figure 1:
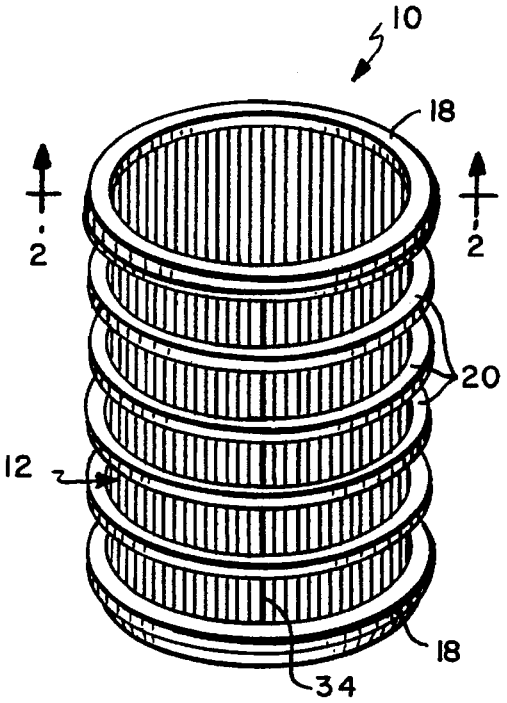
FIG. 1 is a view in perspective of a slotted screen basket in accordance with the present invention.
Figure 2:
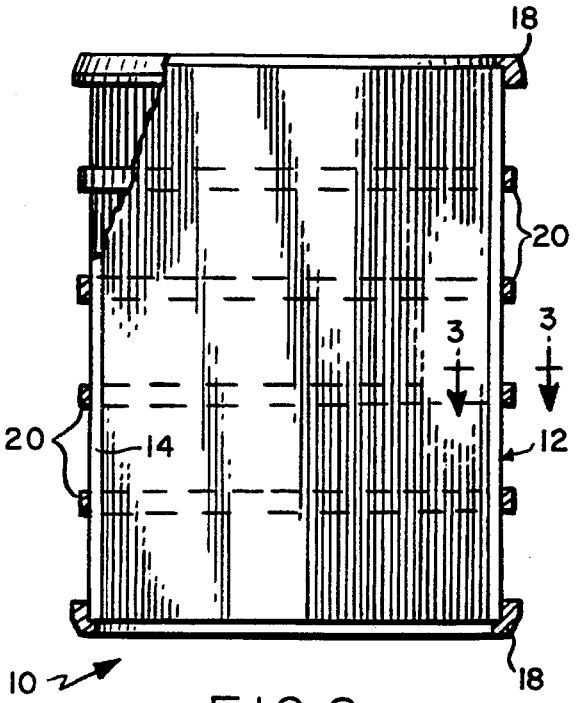
FIG. 2 is a sectional view on an enlarged scale taken along line 2—2 of FIG. 1.
Figure 3:
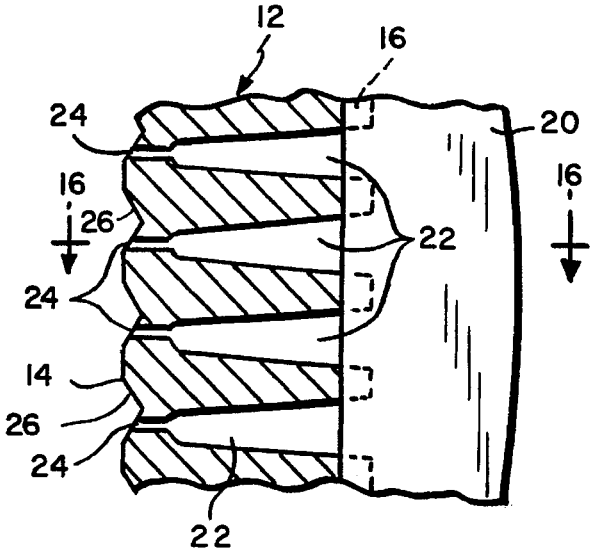
FIG. 3 is a sectional view on a further enlarged scale taken along line 3—3 of FIG. 2.

With reference initially to FIGS. 1–3, a slotted screen basket in accordance with the present invention is shown at 10. The screen basket has a cylindrical slotted wall 12 with an interior feed side 14 and an exterior accept side 16. The opposite ends of the slotted wall 12 are surrounded and reinforced by end tings 18, and the intermediate portion of the wall extending between the end tings is additionally surrounded by mutually spaced reinforcing elements 20.

As can best be seen by reference to FIG. 3, the accept side 16 of the wall 12 is provided with blind parallel relief slots 22 extending continuously between the end rings 18. The reinforcing elements 20 extend transversely across the relief slots. Screening slots 24 extend from the feed side 14 to respective relief slots 22 to thereby provide fluid communication between the feed and accept sides of the wall 12. Preferably, the feed side of the wall is further provided with contour slots 26 which are parallel to and at least partially aligned with respective relief slots 22. The screening slots 24 and the contour slots 26 also extend continuously between the end rings 18.

In a typical screening operation, papermaking stock is pumped under pressure into the interior feed zone of the screen basket. Acceptable fibers pass through the screening slots 24 to the accept side 16 of the basket, and then on to a discharge outlet (not shown). Rejected material flows downwardly along the feed side 14 to a discharge outlet (not shown). A centrally positioned rotating impeller (also not shown) fluidizes the stock and periodically removes fiber bundles and debris which over time, become embedded in the screening slots.

Figures 4, 5, 6, 7, 8:
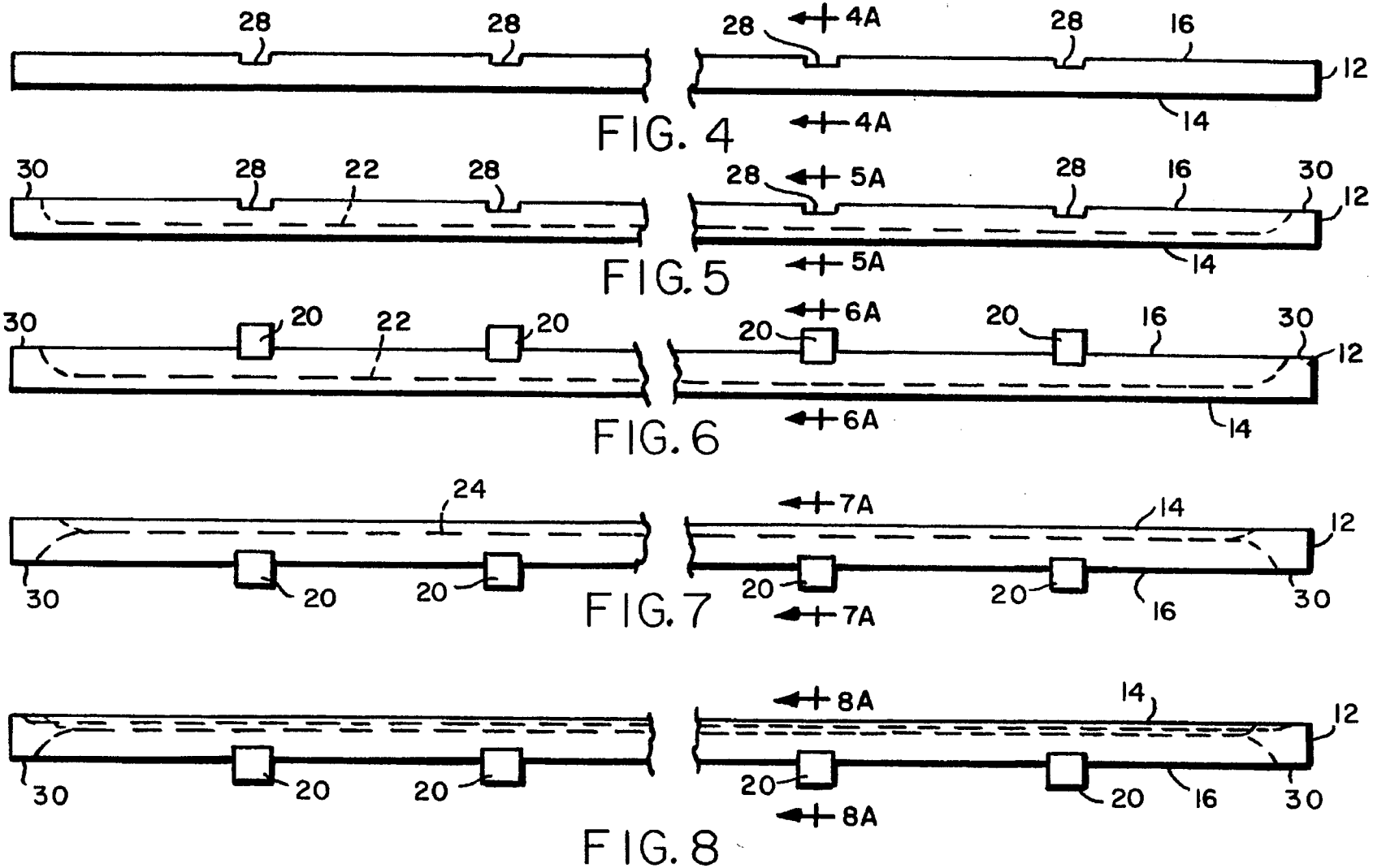
FIGS. 4–8 are diagrammatic sectional views showing the steps employed in slotting and reinforcing a flat plate prior to forming the plate into a basket configuration.
Figure 4A:
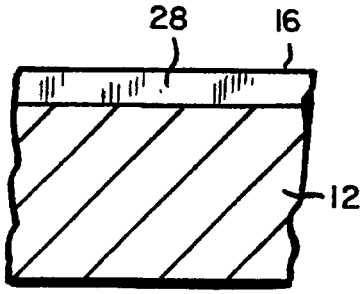
Figure 5A:
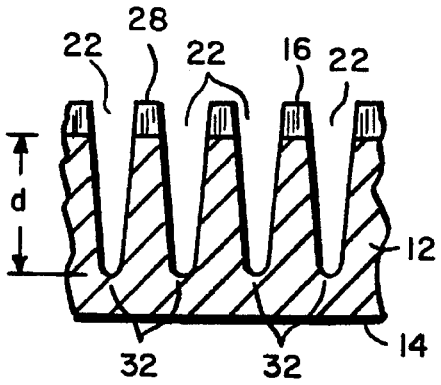

A method of manufacturing the green basket 10 will now be described with further reference to FIGS. 4–8 and 4A–8A. As shown in FIGS. 4 and 4A, the wall 12 begins as a flat plate with oppositely facing feed and accept sides 14, 16. Parallel grooves 28 are initially cut into the accept side 16 of the plate. Thereafter, as illustrated in FIGS. 5 and 5A, the blind relief slots 22 are cut into the accept side 16. The relief slots extend continuously across the plate and transversely with respect to the grooves 28. The ends of the relief slots are spaced inwardly from opposite edges of the plate to thereby provide unslotted lands 30. The relief slots 22 are separated from the feed side 14 of the plate by webs 32 of reduced material thickness, and the webs in turn are spaced from the bottoms of the grooves 28 by the distance "d".

Figure 6A:
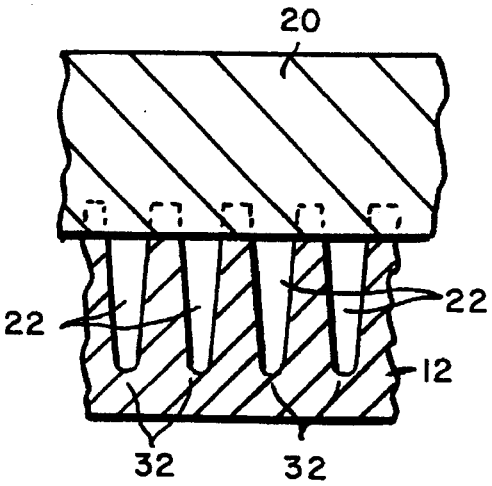

As shown in FIGS. 6 and 6A, the reinforcing elements 20 are next seated in the grooves 28 and are secured to the plate 12 by welding, brazing or other means. The plate 12 and reinforcing elements 20 thus constitute an integral assembly.

Figure 7A:
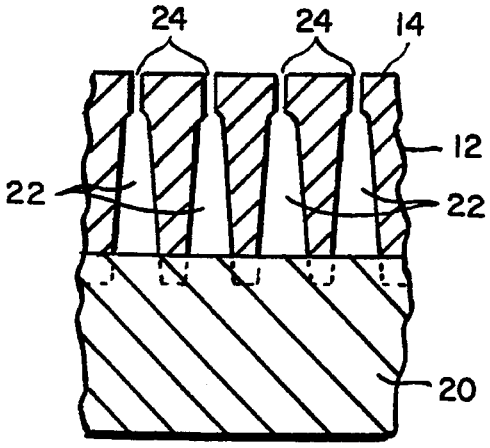
Figure 8A:
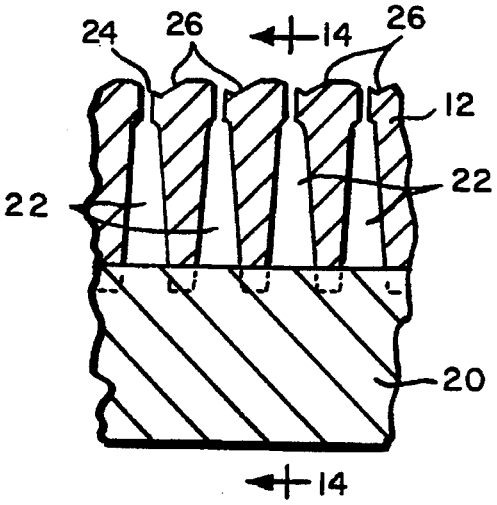

With reference to FIGS. 7 and 7A, the plate 12 is then turned over and the continuous screening slots 24 are cut into the feed side 14. The screening slots are parallel to and in communication with respective relief slots 22. Thereafter, as shown in FIGS. 8 and 8a, the continuous contour slots 26 are cut into the feed side 14 of the plate. The contour slots are each parallel to and at least partially aligned with respective relief slots 22 and their communicating screening slots 24.

The integral assembly consisting of the slotted plate 12 and reinforcing elements 20 is then shaped into a screen basket configuration. Typically, this will entail rolling the assembly into the cylinder depicted in FIGS. 1 and 2. The side edges of the plate and the ends of the reinforcing elements are joined along a seam 34, and the lands 30 are encircled by the end rings 18 to thus complete the basket. Alternatively, the screen basket configuration may be partially cylindrical, with suitably configured reinforcing elements.

Figure 9:
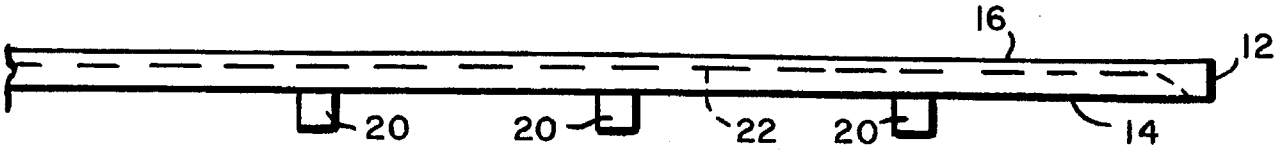
FIGS. 9–12 are diagrammatic sectional views illustrating alternative arrangements for attaching reinforcement elements to the accept side of the screen plate.
Figure 10:
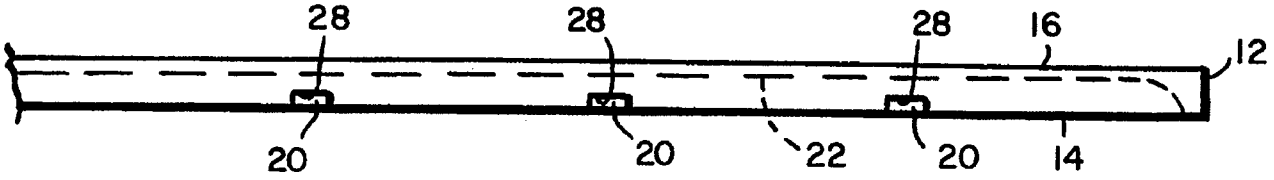
Figure 11:
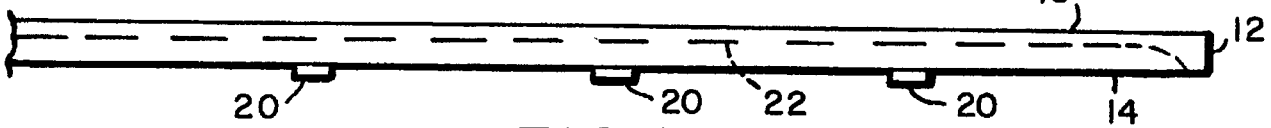

Various modifications may be made to the above described method without departing from the invention as herein claimed. For example, as shown in FIG. 9, the grooves 28 can be eliminated, and the reinforcing elements 20 can simply be applied directly to the accept side 16 of the plate. Alternatively, as shown in FIG. 10, the thickness of the reinforcing elements 20 can be markedly reduced to that of the depth of the grooves 28. This would optimize flexibility for rolling and placement within more robust ting-like reinforcing elements. FIG. 11 illustrates another option where relatively thin reinforcing elements 20 are attached temporarily to the accept side 16 to provide structural integrity during slotting and screen basket formation. More robust ting-like reinforcing elements may then be applied prior to removing the thin elements 20.

Figure 12:
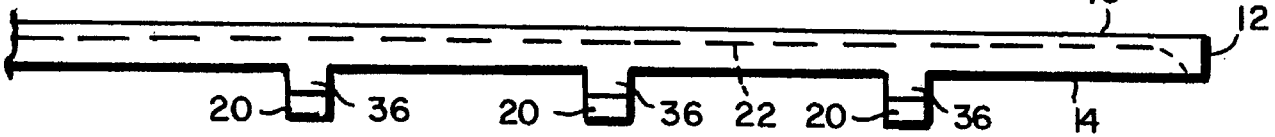

FIG. 12 shows another embodiment where the accept side 16 of the plate is initially machined to provide raised lands 36. Reinforcing elements 20 are secured to the lands 36 after the relief slots 22 have been cut across the accept side.

The contour slots 26 are also optional, and can either be eliminated entirely or replaced by other surface configurations designed to contribute to beneficial localized turbulence at the feed side of the basket. Also, the step of cutting the contour slots 26 can precede that of cutting the screening slots 24.

Figure 13:
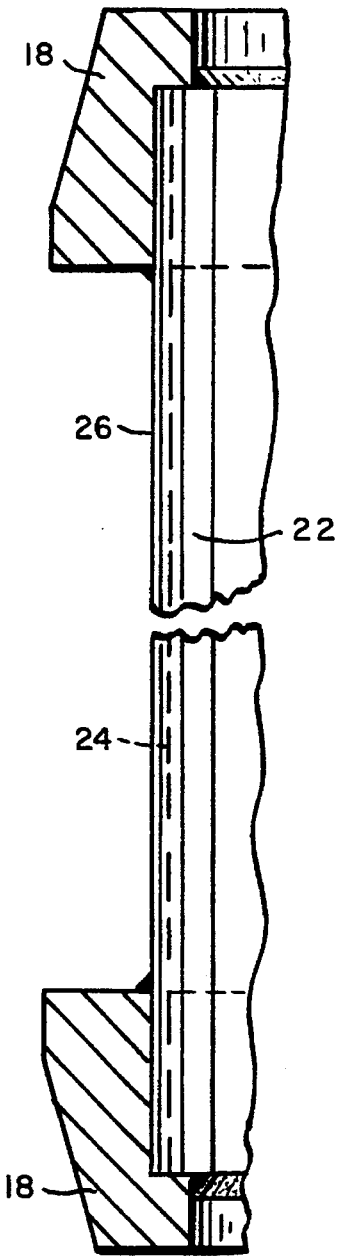
FIGS. 13–15 are longitudinal sectional views taken through the screen basket wall and showing alternative end configurations for the screening, relief and contour slots.
Figure 14:
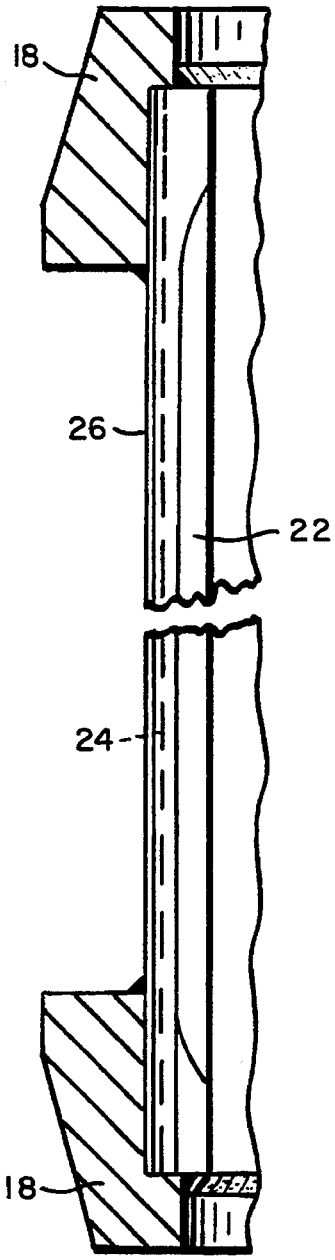
Figure 15:
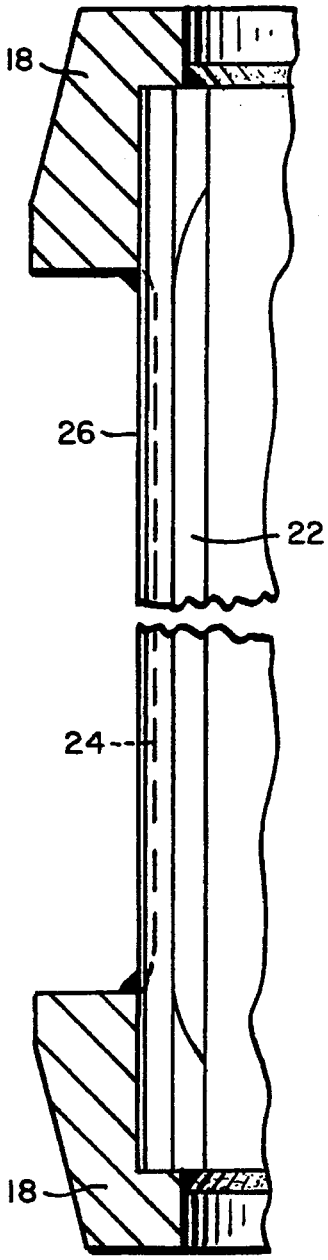

FIGS. 13–15 disclose some alternative slot end configurations. For example, in FIG. 13, the relief, screening and contour slots 22, 24 and 26 extend the full length of the plate, and the end rings 18 overlie the ends of the screening, relief and contour slots. FIG. 14 is similar to FIG. 13, except that the ends of the relief slots 22 are spaced inwardly from respective edges of the plate. In FIG. 15, the ends of the relief and contour slots 22, 26 are spaced from opposite edges of the plate, and only single ends of the screening slots 24 are spaced from a respective plate edge. These slot end configurations are merely illustrative of the various combinations that can be developed to meet varying design and processing requirements.

While it is considered preferable to cut the relief, screening and contour slots into a flat plate which is then shaped into a basket configuration, under certain circumstances it may be desirable to form the plate prior to one or more of the slot cutting steps. Moreover, although the invention has been described in connection with a screen basket adapted to filter paperstock passing radially outwardly through the slotted wall, it will be understood that the same concepts are equally applicable to screen baskets adapted to filter paperstock passing in the opposite direction, i.e., radially inwardly. In this latter case, the relief slots and reinforcing elements would be located at the interior surface of the green basket wall, and the screening slots and contour slots would be located at the exterior surface of the green basket wall.

Figure 16:
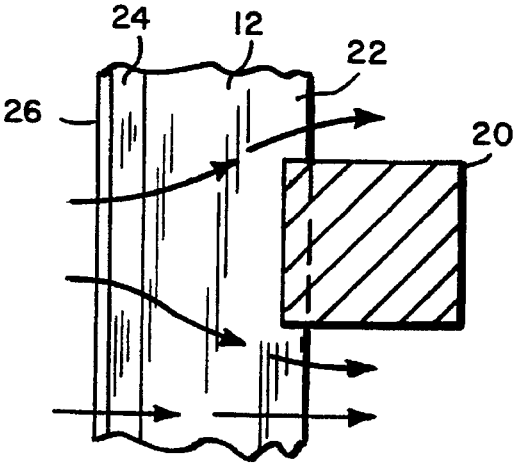
FIG. 16 is a sectional view taken along line 16—16 of FIG. 3.

In all of the above-described embodiments, the relief, screening and contour slots 22, 24 and 26 are continuous, and the screening slots are spaced from the reinforcing elements 20 by the distance d. As shown diagrammatically by the arrows in FIG. 16, this is extremely beneficial in that fibers can pass through the entire lengths of the screening slots and can then continue around the reinforcing elements without snagging and accumulating to cause blockages that disrupt the screening operation.

I claim:

1. A continuous cut slotted screen basket for removing contaminants from papermaking stock, said screen basket comprising:

a wall member having first and second sides bordered by opposite edges;

first reinforcing elements extending along said opposite edges;

blind parallel first slots cut into and spaced across said first side, said first slots extending continuously between said first reinforcing elements and being separated from said second side by webs of reduced wall thickness;

mutually spaced second reinforcing elements secured to said first side, said second reinforcing elements extending transversely across said first slots and being spaced from said webs; and second slots cut through said webs, said second slots extending continuously between said first reinforcing elements and being parallel to and communicating with respective first slots.

2. The screen basket of claim 1 wherein said first and second sides constitute respectively accept and feed sides of said wall member, and wherein said first and second slots constitute respectively relief and screening slots.

3. The screen basket as claimed in claim 2 wherein said second reinforcing elements are seated in grooves in said accept side.

4. The screen basket of claim 2 further comprising contour slots cut into and extending across said feed side, said contour slots being parallel to and at least partially aligned with respective relief slots to define said webs therebetween.

5. The screen basket as claimed in claim 2 wherein the ends of at least one of said relief, contour or screening slots are spaced from an edge of said wall member.

6. The screen basket according to any one of claims 1–4 and 5 wherein said wall member is cylindrical, and said first and second reinforcing elements comprise rings.

* * * * *